US006407621B1

(12) United States Patent
Enriquez

(10) Patent No.: US 6,407,621 B1
(45) Date of Patent: Jun. 18, 2002

(54) MECHANISM FOR GENERATING PRECISION USER-PROGRAMMABLE PARAMETERS IN ANALOG INTEGRATED CIRCUIT

(75) Inventor: Leonel Ernesto Enriquez, Melbourne Beach, FL (US)

(73) Assignee: Intersil Americas Inc., Irvine, CA (US)

( * ) Notice: Subject to any disclaimer, the term of this patent is extended or adjusted under 35 U.S.C. 154(b) by 0 days.

(21) Appl. No.: 09/686,515

(22) Filed: Oct. 11, 2000

(51) Int. Cl.[7] ..... G05F 3/02
(52) U.S. Cl. ..... 327/538
(58) Field of Search ..... 327/530, 538–543; 323/312, 315, 316

(56) References Cited

U.S. PATENT DOCUMENTS 4,604,568 A * 8/1986 Prieto ..... 323/315
5,451,859 A * 9/1995 Ryat ..... 323/312

* cited by examiner

*Primary Examiner*—Kenneth B. Wells
(74) *Attorney, Agent, or Firm*—Allen, Dyer, Doppelt, Milbrath & Gilchrist, P.A.

(57) ABSTRACT

A circuit generates a programmable output current in proportion to the ratio of a precision reference voltage and a programming resistor, such that internal parameters of the circuit are effectively independent of the programming resistor. A bandgap voltage device supplies a reference current proportional to temperature through the collector-emitter path of a reference transistor through a reference resistor. The reference resistor has the same geometry as the internal bandgap's resistor and has a value such that the sum of the base-emitter voltage drop across the reference transistor and the voltage across the reference resistor due to the precision current equals the bandgap voltage. The base of the reference transistor is coupled to the emitter of an output transistor and to a programming resistor. The base of the output transistor is coupled to the collector of the reference transistor, while the collector of the output transistor is coupled to an output terminal, from which a programmed current is supplied based on the value of the programming resistor. The loop equations are such that the output current is definable as the ratio of the bandgap voltage to the value of the programming resistor, and is not affected by base-emitter voltage drops of the reference and output transistors.

15 Claims, 1 Drawing Sheet

MECHANISM FOR GENERATING PRECISION USER-PROGRAMMABLE PARAMETERS IN ANALOG INTEGRATED CIRCUIT

FIELD OF THE INVENTION

The present invention relates in general to integrated circuits and components, such as may be employed in telecommunication circuits and the like, and is particularly directed to a new and improved transistor circuit for generating a programmable output parameter, such as a reference current that is controllably and precisely established by a user-programmable component (resistor) coupled therewith, without internal parameters of the circuit being subject to being modified (distorted) by the programming element.

BACKGROUND OF THE INVENTION

FIG. 1 diagrammatically a conventional bipolar transistor circuit that may be incorporated into a variety of integrated circuits for generating a programmable current reference. For this purpose, a precision voltage element 10, such as a bandgap voltage reference device, is coupled between a (VCC) voltage supply rail 12 and the collector 21 of a bipolar (NPN) reference transistor 20. Transistor 20 has its emitter 22 coupled in circuit with a resistor 25, which is internal to the integrated circuit and is terminated at a reference voltage terminal (ground (GND)). An additional base current offset (NPN) transistor 30, whose collector 31 is tied to the VCC supply rail 12, has its emitter 32 coupled to the base 23 of transistor 20 and its base 33 coupled to the collector 21 of transistor 20. The base 23 of the reference transistor 20 is further coupled in common with the base 43 of an output transistor 40, the emitter 42 of which is coupled to a programming terminal 45 and the collector 41 of which is coupled to an output terminal 50. The programming terminal 45 is adapted to be coupled through a programming circuit element, such as a resistor 47, referenced to ground, while the output terminal 50 is used to supply an output current having a magnitude defined by the value of the programming resistor 47.

Since the intended functionality of the circuit of FIG. 1 is to generate a reference current at output terminal 50 that is precisely established by the value of the programming resistor 47 in proportion to the bandgap voltage of the precision bandgap voltage reference device 10. The insertion of the base current offset transistor 30 serves to reduce the effect of base current errors. In operation, with a programming resistor 47 of some value Rprog coupled between the programming terminal 45 and ground, the following voltage loop equation (1) may be defined:

$$(I_{10}/\alpha_n{}^*R_{25}+\mathrm{Vbe}_{20}(@I_{10}/\alpha_n)=(I_{50}/\alpha_n)^*R_{47}+\mathrm{Vbe}_{40}(@I_{10}/\alpha_n) \quad (1)$$

$$\text{Since, however, } I_{10}=\mathrm{Vbandgap/Rint} \quad (2)$$

where Vbandgap is the bandgap voltage and Rint is a resistor internal to the integrated circuit which matches the resistor 25 (also internal to the integrated circuit, as noted above), then equation (1) may be rewritten as:

$$I_{out}=I_{50}=(1/R_{47})^*(\mathrm{Vbandgap}^*R_{25}/\mathrm{Rint}+\Delta\mathrm{Vbe}_{30,40}) \quad (3)$$

where $\Delta\mathrm{Vbe}_{30,40}$ is the difference between the base-emitter voltage drops of transistors 30 and 40. This base-emitter voltage difference may be significant, even where transistors 30 and 40 are designed to have identical geometries, since there is no way to predict their relative current densities, which are a function of the programming resistor 47. As a result, the internal parameters of the circuit of FIG. 1 are subject to being influenced by the programming element, so that the output current generated at terminal 50 cannot be accurately programmed as desired.

SUMMARY OF THE INVENTION

In accordance with the present invention, this problem is effectively obviated by a relatively simple circuit architecture whose internal parameters are effectively independent of the programming element. Like the architecture of FIG. 1, the present invention makes use of a bandgap voltage reference device incorporated in the integrated circuit. The bandgap voltage reference device generates a reference current $I_{K^*temp}$ that is proportional to temperature (in degrees Kelvin (°K)). This bandgap based reference current $I_{K^*temp}$ is supplied through the collector-emitter path of a reference transistor coupled in circuit with a reference resistor terminated at a reference voltage terminal. The reference resistor has a geometry that effectively matches that of the internal bandgap device's resistance and has a value such that the sum of the base-emitter voltage drop across the reference transistor and the voltage drop across the reference resistor resulting from the reference current $I_{K^*temp}$ is equal to the bandgap voltage.

The base of the reference transistor is further coupled in common with the emitter of an output transistor and to a programming terminal, that is adapted to be coupled to a programming resistor. The base of the output transistor is coupled to the collector of the reference transistor, while the collector of the output transistor is coupled to an output terminal, from which a programmed current is to be supplied in accordance with the value of the programming resistor.

The loop equations for are such that the output current is effectively definable as the ratio of the bandgap voltage Vbandgap to the programming resistor, and is not affected by the base-emitter voltage drops of the reference and output transistors, as in the conventional bandgap-based circuit (shown in FIG. 1). This means that the output current supplied by the invention may be programmed in accordance with the precision of the integrated circuit's internal bandgap device and the tolerance of the programming resistor without significant first order errors.

DETAILED DESCRIPTION

Figure 1:
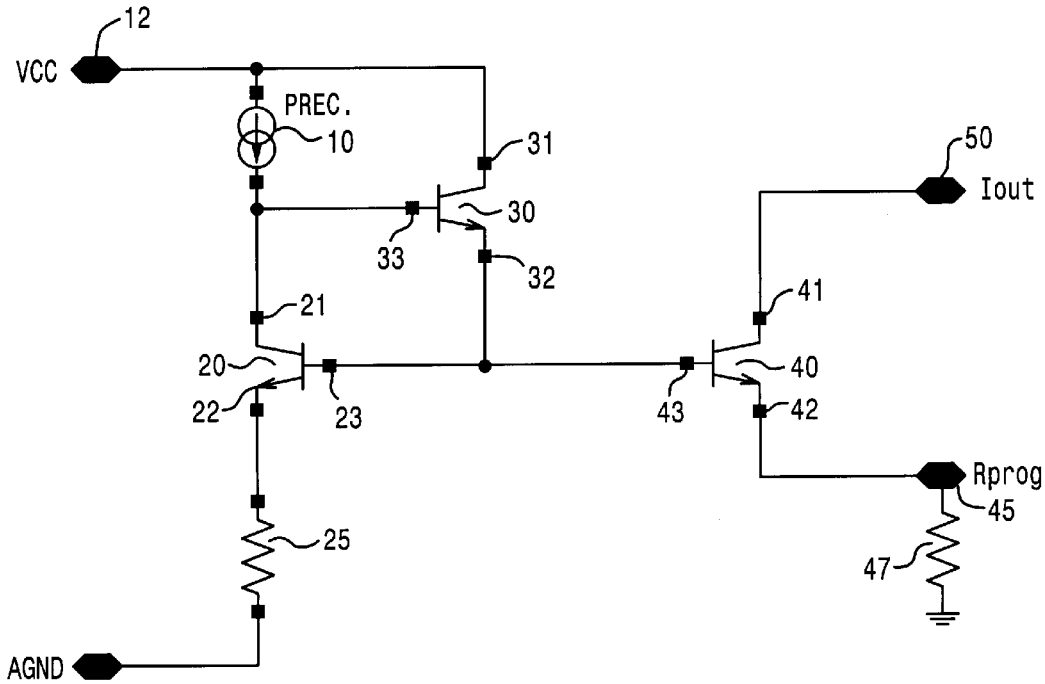
FIG. 1 (PRIOR ART)
FIG. 1 diagrammatically illustrates a conventional transistor circuit that may be employed in an integrated circuit for generating a programmable current reference.
Figure 2:
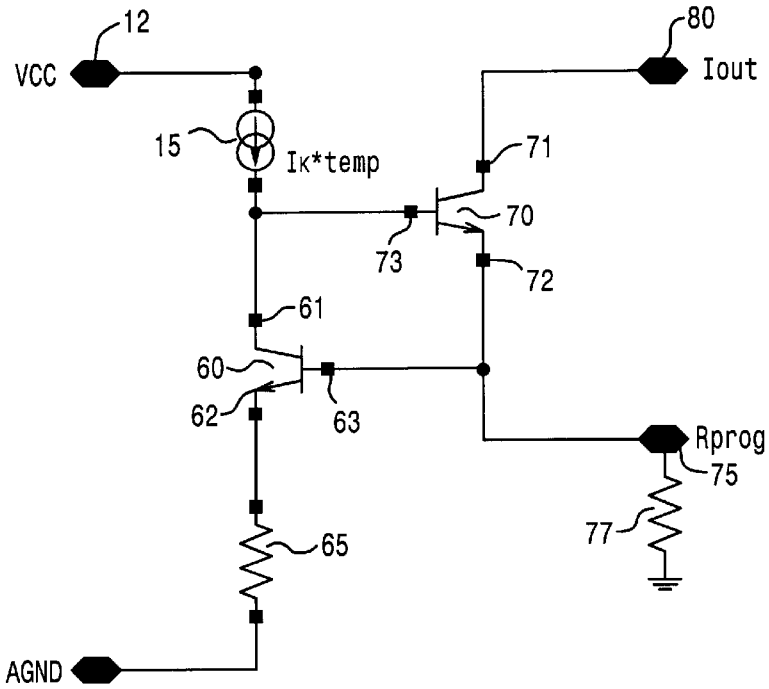
FIG. 2 diagrammatically illustrates an embodiment of a programmable current reference in accordance with the present invention.

Attention is now directed to FIG. 2 which diagrammatically illustrates an embodiment of a programmable current reference in accordance with the present invention, and configured such that internal parameters of the circuit are effectively independent of the programming element. As in the architecture of FIG. 1, it is to be understood that the integrated circuit in which the present invention is employed contains a bandgap reference for the purpose of generating various biasing currents for the integrated circuit, so that there is a current provided within the bandgap reference itself which is proportional to temperature (in degrees Kelvin (°K)).

This is shown in FIG. 2 as current source 15, which is referenced to (VCC) voltage supply rail 12 and supplies an output current $I_{K^*temp}$ to the collector 61 of a bipolar (NPN) reference transistor 60. It is to be understood that the polarities of the components of FIG. 2, including those of the devices and bias and supply sources, may be reversed without departing from the scope of the invention. In terms of the components NPN devices are shown as a non-limiting example; PNP devices may also be used with appropriate change in polarity of biasing, with which those skilled in the art are familiar. Transistor 60 has its emitter 62 coupled in circuit with a reference resistor 65 which, like resistor 25 in the circuit of FIG. 1, is internal to the integrated circuit and is terminated at a reference voltage terminal (ground (GND)). Reference resistor 65 has a geometry that effectively matches that of the internal bandgap reference resistor and has a value $R_{65}$ such that:

$$\mathrm{Vbe}_{60}+I_{K^*temp}*R_{65}=\mathrm{Vbandgap} \quad (4)$$

The base 63 of the reference transistor 60 is coupled in common with the emitter 72 of an output transistor 70 and to a programming terminal 75. As in the circuit of FIG. 1, the programming terminal 75 is adapted to be coupled through a programming circuit element, such as a resistor 77, referenced to ground. The base 73 of output transistor 70 is coupled to the collector 61 of transistor, while the collector 71 of output transistor 70 is coupled to an output terminal 80. As in the circuit of FIG. 1, the output terminal 80 is used to supply an output current $I_{out}$ (corresponding to the collector—emitter current through transistor 70) having a magnitude defined by the value of the programming resistor 77.

Since equation (4), set forth above, holds irrespective of the value of the programming resistor, then the following equation (5) for the collector—emitter current $I_{80}$ through output transistor 80 may be defined:

$$I_{80}/\alpha_n=I_{K^*temp}/\beta_n+\mathrm{Vbandgap}/R_{77} \quad (5)$$

or, since $\alpha_n=\beta_n/(\beta_n+1)$ $$I_{80}*(\beta_n+1)/\beta_n=I_{K^*temp}/\beta_n+\mathrm{Vbandgap}/R_{77} \quad (6)$$

Rewriting equation (6) in terms of output current $I_{out}=I_{80}$, $$I_{out}=(\beta_n/(\beta_n+1))*(\mathrm{Vbandgap}/R_{77})+I_{K^*temp}/(\beta_n+1). \quad (7)$$

In general, the errors related to $\beta_n$ in equation (7) are negligible with respect to the intended result. If this is not the case, a base current error cancellation techniques can be used, to realize equation (8), as follows:

$$I_{out}=\mathrm{Vbandgap}/R_{77} \quad (8)$$

As a non-limiting, but preferred example, such a base-current error cancellation scheme may be of the type described in my co-pending U.S. application Ser. No. 09/686,633, filed on Nov. 11, 2000, entitled: "Transistor Base Current Error Correction Scheme for Low Overhead Voltage Applications," assigned to the assignee of the present application and the disclosure of which is incorporated herein.

It will be appreciated, therefore, that unlike the conventional bandgap-based circuit of FIG. 1, in which the output current $I_{out}$ at output terminal 50 is subject to the (potentially significant) difference between the base-emitter voltage drops of transistors 30 and 40, the output current $I_{out}$ at output terminal 80 of the circuit of FIG. 2, is independent of such a variable (base-emitter voltage drop) factor, so that the output current $I_{out}$ generated at the output terminal 80 may be programmed in accordance with the precision of the integrated circuit's internal bandgap device and the tolerance of the programming resistor 77, without any significant first order errors.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein, but intend to cover all such changes and modifications as are obvious to one of ordinary skill in the art.

What is claimed is:

1. A circuit for generating programmable output current comprising:

a bandgap voltage device, that provides a reference current;

a reference bipolar transistor having a collector emitter current flow path coupled in circuit with a reference resistor, said current flow path being coupled to receive said reference current from said bandgap voltage device;

an output bipolar transistor having a collector emitter current flow path coupled in circuit between an output terminal, from which said programmable output current is supplied, and a programming terminal that is adapted to be coupled to a programming resistor terminated at a reference voltage terminal; and wherein said output bipolar transistor is coupled to said reference bipolar transistor in a manner such that said programmable output current is substantially independent of any difference in base-emitter voltage drops of said reference and output bipolar transistors.

2. A circuit according to claim 1, wherein said reference current provided by said bandgap voltage device is proportional to temperature.

3. A circuit according to claim 1, wherein said output bipolar transistor has its base coupled to the collector of said reference bipolar transistor, and its emitter coupled to the base of said reference bipolar transistor.

4. A circuit according to claim 3, wherein said reference resistor has a geometry that effectively matches that of an internal bandgap reference resistor of said bandgap voltage device, and a value such that the sum of a base-emitter voltage of said reference transistor and a voltage across said reference resistor resulting from said reference current flowing therethrough is equal to said bandgap voltage.

5. A circuit according to claim 4, wherein said reference current provided by said bandgap voltage device is proportional to temperature.

6. A circuit according to claim 4, wherein said reference transistor and said output transistor are like polarity transistors.

7. A circuit for generating a programmable output current that is proportional to the ratio of a precision reference voltage and a programming resistor, comprising:

a reference bipolar transistor having a collector emitter—current flow path therethrough coupled in circuit with a precision reference voltage bandgap device, that provides a reference current proportional to temperature, and a reference resistor terminated at a reference voltage terminal; and an output bipolar transistor having a collector emitter—current flow path therethrough coupled in circuit between an output terminal, from which said programmable output current is derived, and a programming terminal that is adapted to be coupled to said programming resistor that is terminated at a reference voltage terminal, said output bipolar transistor having its base coupled to the collector of said reference bipolar transistor, and its emitter coupled to the base of said reference bipolar transistor.

8. A circuit according to claim 7, wherein said reference resistor has a geometry that effectively matches that of an internal bandgap reference resistor of said bandgap voltage device, and a value such that the sum of a base-emitter voltage of said reference transistor and a voltage across said reference resistor resulting from said collector-emitter current flowing therethrough is equal to said precision reference voltage.

9. A circuit according to claim 8, wherein said reference transistor and said output transistor are like polarity transistors.

10. A method for generating programmable output current comprising the steps of:

(a) supplying a precision reference current produced by a bandgap voltage device through a current flow path that includes the collector—emitter current flow path of a reference bipolar transistor and a reference resistor;

(b) providing an output bipolar transistor having a collector—emitter current flow path coupled in circuit between an output terminal, from which said programmable output current is supplied, and a programming terminal that is adapted to be coupled to a programming resistor; and (c) coupling said output bipolar transistor to said reference bipolar transistor in a manner such that said programmable output current is substantially independent of any difference in base-emitter voltage drops of said reference and output bipolar transistors.

11. A method according to claim 10, wherein said precision reference current supplied by said bandgap voltage device is proportional to temperature.

12. A method according to claim 10, wherein step (c) comprises coupling the base of said output bipolar transistor to the collector of said reference bipolar transistor, and coupling the emitter of said output transistor to the base of said reference bipolar transistor.

13. A method according to claim 12, wherein said reference resistor has a geometry that effectively matches that of an internal bandgap reference resistor of said bandgap voltage device, and a value such that the sum of a base-emitter voltage of said reference transistor and a voltage across said reference resistor resulting from said precision reference current flowing therethrough is equal to said bandgap voltage.

14. A method according to claim 13, wherein said reference current provided by said bandgap voltage device is proportional to temperature.

15. A method according to claim 14, wherein said reference transistor and said output transistor are like polarity transistors.

* * * * *